US009360779B2

(12) United States Patent
Ikari et al.

(10) Patent No.: US 9,360,779 B2
(45) Date of Patent: Jun. 7, 2016

(54) ELECTROPHOTOGRAPHIC PHOTOCONDUCTOR, PROCESS CARTRIDGE, AND ELECTROPHOTOGRAPHIC APPARATUS

(71) Applicant: CANON KABUSHIKI KAISHA, Tokyo (JP)

(72) Inventors: Kenichi Ikari, Abiko (JP); Wataru Kitamura, Abiko (JP); Mai Murakami, Kashiwa (JP); Daisuke Tanaka, Yokohama (JP); Kazumichi Sugiyama, Numazu (JP); Takeshi Murakami, Numazu (JP); Daisuke Kawaguchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/627,989

(22) Filed: Feb. 20, 2015

(65) Prior Publication Data

US 2015/0241803 A1 Aug. 27, 2015

(30) Foreign Application Priority Data

Feb. 24, 2014 (JP) ..... 2014-033341

(51) Int. Cl.
*G03G 5/14* (2006.01)
*G03G 5/147* (2006.01)

(52) U.S. Cl.
CPC ..... *G03G 5/14* (2013.01); *G03G 5/144* (2013.01); *G03G 5/147* (2013.01)

(58) Field of Classification Search
CPC ..... G03G 5/144
USPC ..... 430/60, 63, 65
See application file for complete search history.

(56) References Cited

U.S. PATENT DOCUMENTS

| | | | | |
|---|---|---|---|---|
| 2006/0234146 | A1* | 10/2006 | Miki | G03G 5/104 430/63 |
| 2012/0114375 | A1* | 5/2012 | Fujii | G03G 5/144 399/111 |
| 2014/0065529 | A1* | 3/2014 | Fujii | G03G 5/104 430/56 |

FOREIGN PATENT DOCUMENTS

| | | | | |
|---|---|---|---|---|
| JP | H11292535 | A | 10/1999 | |
| JP | 2003128417 | A | 5/2003 | |
| JP | 2009288629 | A | 12/2009 | |
| JP | 2012018370 | A | 1/2012 | |
| WO | WO 2015099191 | A1 * | 7/2015 | G03G 5/144 |

* cited by examiner

*Primary Examiner* — Christopher Rodee
(74) *Attorney, Agent, or Firm* — Canon U.S.A. Inc., IP Division

(57) ABSTRACT

An electrophotographic photoconductor has a support medium, an undercoat layer formed immediately on the support medium, and a photosensitive layer formed immediately on the undercoat layer, in which the undercoat layer contains a binding resin and composite particles each containing a core material particle covered with tin oxide doped with a predetermined amount of aluminum.

10 Claims, 2 Drawing Sheets

ELECTROPHOTOGRAPHIC PHOTOCONDUCTOR, PROCESS CARTRIDGE, AND ELECTROPHOTOGRAPHIC APPARATUS

BACKGROUND OF THE INVENTION

1. Field of the Invention

The present invention relates to an electrophotographic photoconductor and a process cartridge and an electrophotographic apparatus having the electrophotographic photoconductor.

2. Description of the Related Art

As an electrophotographic photoconductor for use in an electrophotographic apparatus, an electrophotographic photoconductor having an undercoat layer containing metal oxide particles and a photosensitive layer containing a charge generation material and a charge transport material formed immediately on the undercoat layer is used.

As the metal oxide particles for use in the undercoat layer, tin oxide particles, titanium oxide particles, zinc oxide particles, and the like are used. Among the above, it is known that the electrical resistance of the tin oxide particles varies depending on the oxygen deficiency degree and the electrical resistance of the tin oxide particles becomes lower with an increase in the oxygen deficiency degree.

However, in the undercoat layer containing the tin oxide particles, moisture and the like in the atmosphere are likely to adhere to the surface of the tin oxide particles, so that the oxygen deficiency is inactivated, which increases the electrical resistance of the tin oxide particles, and thus potential changes are likely to occur. In particular, in a high temperature and high humidity environment (e.g., high temperature and high humidity environment of 30° C./85% RH or more), due to the fact that a large amount of moisture is present in the electrophotographic apparatus, potential changes in repeated use for a prolonged period of time (light area potential changes and dark area potential changes) tend to occur.

As a technique of suppressing the potential changes by metal oxide particles, Japanese Patent Laid-Open No. 2012-18370 discloses a technique of using metal oxide particles doped with a different element for a conductive layer.

Japanese Patent Laid-Open No. 2009-288629 discloses a technique of using metal oxide particles for an undercoat layer.

In recent years, an improvement of the durability of an electrophotographic photoconductor and stabilization of an image in repeated use have been demanded with an increase in image quality and an increase in process speed of an electrophotographic apparatus. Therefore, it has been demanded to achieve both suppression of the light area potential changes and suppression of dark area potential changes in repeated use of the electrophotographic photoconductor.

As a result of an examination of the present inventors, it has been found that the following problems arise in the layer configuration of a support medium, an undercoat layer immediately on the support medium, and a photosensitive layer immediately on the undercoat layer. More specifically, it has been found that undercoat layers containing metal oxide particles described in Japanese Patent Laid-Open Nos. 2012-18370 and 2009-288629 have room for an improvement of the light area potential changes and the dark area potential changes in repeated use.

SUMMARY OF THE INVENTION

Aspects of the present invention provide an electrophotographic photoconductor in which light area potential changes and dark area potential changes in repeated use for a long period of time are suppressed. Aspects of the present invention also provide a process cartridge and an electrophotographic apparatus having the electrophotographic photoconductor.

Aspects of the present invention may provide an electrophotographic photoconductor having:

a support medium;

an undercoat layer formed immediately on the support medium; and a photosensitive layer formed immediately on the undercoat layer in which the undercoat layer contains a binding resin and composite particles, the composite particles each containing a core material particle and tin oxide covering the core material particle and doped with aluminum, and the doping amount of the aluminum based on the tin oxide is 1% by mass or more and 4% by mass or less.

Aspects of the present invention may also provide a process cartridge which integrally supports the electrophotographic photoconductor and at least one device selected from the group consisting of a charging device, a developing device, a transfer device, and a cleaning device and which is attachable/detachable to/from an electrophotographic apparatus main body.

Aspects of the present invention may also provide an electrophotographic apparatus having the electrophotographic photoconductor, a charging device, an exposure device, a developing device, and a transfer device.

Further features of the present invention will become apparent from the following description of exemplary embodiments with reference to the attached drawings.

DESCRIPTION OF THE EMBODIMENTS

Hereinafter, the present invention is described in detail.

An electrophotographic photoconductor according to aspects of the present invention has a support medium, an undercoat layer provided immediately on the support medium, and a photosensitive layer provided immediately on the undercoat layer. The photosensitive layer includes a single-layer type photosensitive layer in which a charge generation material and a charge transport material are contained in a single layer and a multi-layer type photosensitive layer in which a charge generation layer containing a charge generation material and a charge transport layer containing a charge transport material are laminated. The multi-layer type photosensitive layer is suitable.

Figure 1:
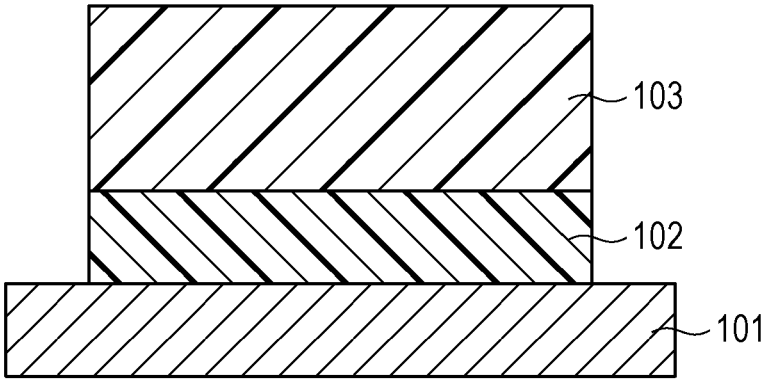
FIG. 1 is a view illustrating an example of the layer configuration of an electrophotographic photoconductor.

FIG. 1 illustrates an example of the layer configuration of the electrophotographic photoconductor according to aspects of the present invention. FIG. 1 includes a support medium 101, an undercoat layer 102, and a photosensitive layer 103.

In aspects of the present invention, the undercoat layer of the electrophotographic photoconductor contains a binding resin and composite particles. The composite particles each contains a core material particle and tin oxide covering the core material particle and doped with aluminum, in which the doping amount of the aluminum based on the tin oxide is 1% by mass or more and 4% by mass or less.

The undercoat layer contains composite particles each containing a core material particle covered with tin oxide doped with aluminum as metal oxide particles. The composite particles each is a composite particle in which the core material particle is covered with a cover layer containing tin oxide doped with aluminum.

The powder resistivity of the core material particles is suitably $1.0\times10^5$ to $1.0\times10^{10}$ Ω·cm. Examples of the core material particles include titanium oxide particles, barium sulfate particles, zinc oxide particles, and tin oxide particles, for example. Titanium oxide particles or barium sulfate particles are suitable.

The present inventors presume a reason why the use of the composite particles for the undercoat layer of the electrophotographic photoconductor suppresses the light area potential changes and the dark area potential changes in repeated use as follows.

The present inventors presume that, by covering the core material particles with tin oxide doped with aluminum, temporal electrical resistance changes in connection with environmental changes resulting from oxygen deficiency of the metal oxide particles can be suppressed. Thus, the present inventors presume that the light area potential changes can be sufficiently suppressed. Moreover, it has been found that, in the case of tin oxide (cover layer) doped with elements other than aluminum, the electrical resistance is likely to decrease but, by changing the element doping the tin oxide to aluminum, the electrical resistance reduction is suppressed. The present inventors presume that, by suppressing a reduction in the electrical resistance, the leak resistance of the undercoat layer is improved and a reduction in the potential of the surface of the photoconductor due to leaking is suppressed, so that the dark area potential changes can be suppressed.

A method for producing the tin oxide ($SnO_2$) doped with aluminum is described in Japanese Patent Laid-Open Nos. 2003-128417 and 11-292535.

In the composite particles, the doping amount of the aluminum based on the tin oxide is 1% by mass or more and 4% by mass or less. When the doping amount of the aluminum is smaller than 1% by mass, an effect of suppressing the electrical resistance changes in connection with environmental changes decreases, and therefore the light area potential changes are likely to be large. When the doping amount of the aluminum based on the tin oxide is larger than 4% by mass, it tends to be difficult to maintain the crystal structure of the tin oxide, so that the electrical resistance of the cover layer becomes unstable, and thus the dark area potential changes are likely to be large.

The doping amount of the aluminum based on the tin oxide can be measured using a wavelength dispersion type fluorescent X-ray analyzer (Trade name: Axios), for example. As a measurement target, the undercoat layer collected after removing the photosensitive layer of the electrophotographic photoconductor can be used or powder of composite particles each containing the same materials as the materials of the undercoat layer can be used. Herein, the doping amount of the aluminum based on the tin oxide is a value calculated from the mass of the alumina ($Al_2O_3$) based on the mass of the tin oxide.

The coverage (ratio) of the tin oxide in the composite particles is suitably 20% by mass or more and 60% by mass or less. Herein, the coverage is a value calculated based on the mass of the tin oxide based on the total mass of the tin oxide and the core material particle without considering the mass of the aluminum doping the tin oxide. When the coverage is within this range, the covering of the core material particle becomes more uniform, so that the electrophotographic photoconductor is difficult to be affected by the influence of the electrical resistance changes caused by environmental changes, so that the light area potential changes are further suppressed.

The powder resistivity of the composite particles is suitably $1\times10^6$ Ω·cm or more and particularly suitably $1.5\times10^8$ Ω·cm or more and $1\times10^9$ Ω·cm or less. When the powder resistivity is $1\times10^6$ Ω·cm or more, the light area potential changes and the dark area potential changes in repeated use are sufficiently suppressed.

The powder resistivity of the composite particles is measured in a normal temperature and normal humidity (23° C./50% RH) environment. As a measuring apparatus, an electrical resistance measuring apparatus manufactured by Mitsubishi Chemical Corporation (Trade name: Loresta GP) is used. The composite particles as a measurement target are hardened under a pressure of 500 kg/cm$^2$ to be formed into a pellet-shaped measurement sample, and then the measurement sample is measured at an applied voltage of 100 V.

The undercoat layer can be formed by forming a coating film of a coating liquid for undercoat layer obtained by dispersing composite particles in a solvent together with a binding resin, and then drying and/or curing the coating film.

The binding resin for use in the undercoat layer includes phenol resin, polyurethane, polyamide, polyimide, polyamide imide, polyvinyl acetal, epoxy resin, acrylic resin, melamine resin, polyester, and the like, for example. Among the above, cured resin is suitable from the viewpoint of suppressing migration (melting) into other layers (e.g., photosensitive layer), the dispersibility of the composite particles, and the like.

The cured resin includes polyurethane resin, phenol resin, epoxy resin, acrylic resin, and melamine resin. Polyurethane resin is suitable from the viewpoint of further suppressing the dark area potential changes. The polyurethane resin is a cured substance of block isocyanate and polyol resin.

The block isocyanate includes, for example, substances obtained by blocking 2,4 tolylenediisocyanate, 2,6 tolylenediisocyanate, diphenyl methane-4,4'-diisocyanate, hexamethylene diisocyanate, a hexamethylene-trimethylol propane adduct, a hexamethylene-isocyanurate body, a hexamethylene-biuret body, and the like with oximes. Examples of the oximes include formaldehyde oxime, acetoaldo oxime, methyl ethyl ketone oxime, and cyclohexanone oxime.

The polyol resin includes, for example, polyvinyl acetal resin, polyether polyol resin, polyester polyol resin, acryl polyol resin, epoxy polyol resin, and fluorine polyol resin.

The mass ratio of the contents of the composite particles and the binding resin in the undercoat layer is suitably Composite particles:Binding resin=2:1 to 4:1. The mass ratio is more suitably 2.6:1 to 4:1.

The volume resistivity of the undercoat layer is suitably $1\times10^9$ Ω·cm or more and $1\times10^{13}$ Ω·cm or less. The volume resistivity is more suitably $1\times10^{12}$ Ω·cm or more and $1\times10^{13}$ Ω·cm or less. When the undercoat layer satisfies the volume resistivity, spots and fog occurring when image forming is repeatedly performed in a high temperature and high humidity environment are suppressed.

Figure 3:
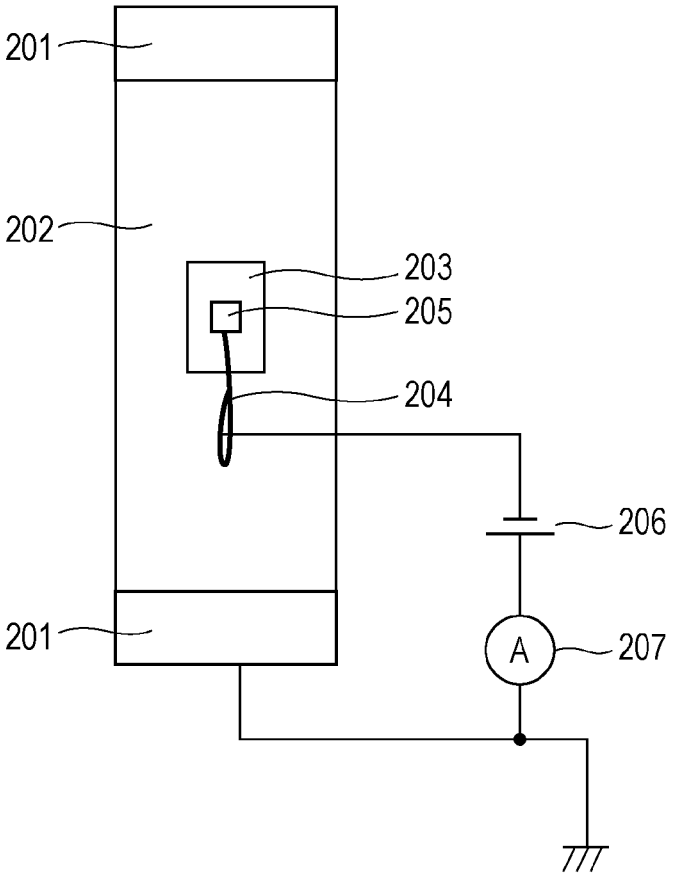
FIG. 3 is a view (top view) for explaining a measuring method of the volume resistivity of an undercoat layer.
Figure 4:
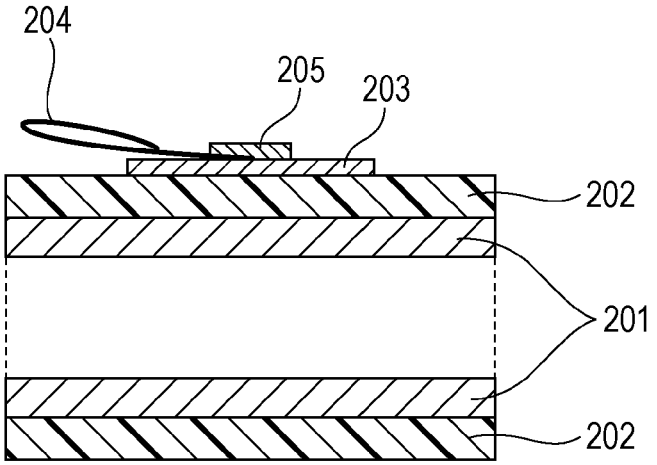
FIG. 4 is a view (cross sectional view) for explaining a measuring method of the volume resistivity of an undercoat layer.

A method for measuring the volume resistivity of the undercoat layer is described with reference to FIG. 3 and FIG. 4. FIG. 3 is a top view for explaining the measuring method of the volume resistivity of the undercoat layer. FIG. 4 is a cross sectional view for explaining the measuring method of the volume resistivity of the undercoat layer.

The volume resistivity of the undercoat layer is measured in a normal temperature normal humidity (23° C./50% RH) environment. A copper tape 203 (manufactured by Sumitomo 3M, Model Number No. 1181) is stuck to the surface of the undercoat layer 202 to be used an electrode on the surface side of the undercoat layer 202. The support medium 201 is used as an electrode on the back side of the undercoat layer 202. A power supply 206 for applying a voltage and a current meter 207 for measuring a current flowing between the copper tape 203 and the support medium 201 are individually provided between the copper tape 203 and the support medium 201. Moreover, in order to apply a voltage to the copper tape 203, a copper wire 204 is placed on the copper tape 203. Then, a copper tape 205 similar to the copper tape 203 is stuck to the top of the copper wire 204 so that the copper wire 204 does not protrude from the copper tape 203 to fix the copper wire 204. A voltage is applied to the copper tape 203 using the copper wire 204.

A value given by the following expression (1) is used as the volume resistivity ρ (Ω·cm) of the undercoat layer 202.

$$\rho=1/(I-I_0)\times S/d\ (\Omega\cdot\text{cm}) \quad (1)$$

In Expression (1), $I_0$ represents a background current value (A) when a voltage is not applied between the copper tape 203 and the support medium 201. I represents a current value (A) when a voltage of only a direct-current (direct-current component) of −1 V is applied. d represents the film thickness (cm) of the undercoat layer 202. S represents the area ($cm^2$) of the electrode (copper tape 203) on the surface side of the undercoat layer 202.

In this measurement, a minute current amount of $1\times10^{-6}$ A or less in terms of absolute value is measured. Therefore, the measurement is suitably performed using a meter capable of measuring a minute current as the current meter 207. Such a meter includes a pA meter manufactured by YOKOGAWA Hewlett Packard Co. (Trade name: 4140B), a high resistance meter (Trade name: 4339B) manufactured by Agilent Technologies, and the like, for example.

The film thickness of the undercoat layer is suitably 10 μm or more and 40 μm or less and more suitably 22 μm or more and 30 μm or less from the viewpoint of suppressing the potential changes.

In the undercoat layer, additives may be further blended. For example, known materials, such as electro conductive materials, e.g., carbon black, electron transporting materials, metal chelate compounds, and organometallic compounds, can be blended.

Examples of a solvent for use in the coating liquid for undercoat layer include solvents, such as an alcoholic solvent, a sulfoxide solvent, a ketone solvent, an ether solvent, an ester solvent, an aliphatic halogenated hydrocarbon solvent, and an aromatic compound. In aspects of the present invention, it is suitable to use the alcoholic solvent and the ketone solvent.

Dispersion methods include methods employing a homogenizer, an ultrasonic disperser, a ball mill, a sand mill, a roll mill, a vibration mill, an Attritor, and a liquid collision type high-speed disperser.

Support Medium

The support medium is suitably one having electroconductivity (electroconductive support medium). For example, metal support media formed with metals or alloys, such as aluminum, stainless steel, copper, nickel, and zinc, are mentioned. Metal support media and plastic support media having a layer covered with aluminum, aluminum alloy, indium oxide-tin oxide alloy, and the like by vacuum deposition can also be used. Moreover, support media obtained by impregnating plastic and paper with electroconductive particles, such as carbon black, tin oxide particles, titanium oxide particles, and silver particles, together with a binding resin and plastic support media having an electroconductive binding resin can also be used. The shape of the support medium includes a cylindrical shape and a belt shape and is suitably a cylindrical shape.

The surface of the support medium may be subjected to cutting treatment, roughing treatment, or alumite treatment for the purpose of suppressing interference fringes due to scattering of laser light.

Undercoat Layer

Between the support medium and the photosensitive layer, the above-described undercoat layer is provided.

Photosensitive Layer

Immediately on the undercoat layer, a photosensitive layer (a charge generation layer, a charge transport layer) is formed.

Charge generation materials include azo pigments, phthalocyanine pigments, indigo pigments, perylene pigments, polycyclic quinone pigments, squarylium pigments, pyrylium salts and thiapyrylium salts, and triphenylmethane dyes, for example. These charge generation materials may be used singly or in combination of two or more kinds thereof.

Among these charge generation materials, phthalocyanine pigments and azo pigments are suitable from the viewpoint of sensitivity and phthalocyanine pigments are particularly more suitable.

Among the phthalocyanine pigments, particularly, oxytitanium phthalocyanines, chlorogallium phthalocyanines, or hydroxy gallium phthalocyanines demonstrate excellent charge generation efficiency.

Furthermore, among the hydroxy gallium phthalocyanines, hydroxy gallium phthalocyanine crystals having a crystal form having peaks at Bragg angles 2θ in CuKα characteristic X-ray diffraction of 7.4°±0.3° and 28.2°±0.3° are more suitable.

When the photosensitive layer is a multi-layer type photosensitive layer, the charge generation layer can be formed by applying a coating liquid for charge generation layer obtained by dispersing a charge generation material in a solvent together with a binding resin to form a coating film, and then drying the coating film.

Examples of the binding resin for use in the charge generation layer include, for example, acrylic resin, allyl resin, alkyd resin, epoxy resin, diallyl phthalate resin, a styrene-butadiene copolymer, butyral resin, benzal resin, polyacrylate, polyacetal, polyamide imide, polyamide, polyallyl ether, polyarylate, polyimide, polyurethane, polyester, polyethylene, polycarbonate, polystyrene, polysulfone, polyvinyl acetal, polybutadiene, polypropylene, methacrylic resin, urea resin, vinyl chloride-vinyl acetate copolymer, vinyl acetate resin, and vinyl chloride resin. Among the above, butyral resin is suitable. These substances can be used singly or in combination of two or more kinds thereof as a mixture or a copolymer.

Dispersion methods include, for example, methods employing a homogenizer, an ultrasonic disperser, a ball mill, a sand mill, a roll mill, a vibration mill, an Attritor, and a liquid collision type high-speed disperser.

The mass ratio of the charge generation material and the binding resin in the charge generation layer is suitably Charge generation material/Binding resin=0.3/1 or more and 10/1 or less.

Solvents for use in the coating liquid for charge generation layer include organic solvents, such as alcohol, sulfoxide, ketone, ether, ester, aliphatic halogenated hydrocarbon, and aromatic compounds, for example.

The film thickness of the charge generation layer is suitably 0.1 μm or more and 5 μm or less and more suitably 0.1 μm or more and 2 μm or less.

To the charge generation layer, various sensitizers, antioxidants, ultraviolet absorbers, plasticizers, and the like can also be added as required. In order not to block the flow of charges in the charge generation layer, an electron transport material (electron receiving material) may be blended in the charge generation layer.

When the photosensitive layer is a multi-layer type photosensitive layer, the charge transport layer can be formed by forming a coating film of a coating liquid for charge transport layer obtained by dissolving a charge transport material and a binding resin in a solvent, and then drying the coating film.

The charge transport material includes triaryl amine compounds, hydrazone compounds, styryl compounds, stilbene compounds, and butadiene compounds, for example. These charge transport materials may be used singly or in combination of two or more kinds thereof. Among the charge transport materials, triaryl amine compounds are suitable from the viewpoint of the mobility of charges.

The binding resin for use in the charge transport layer includes, for example, acrylic resin, acrylonitrile resin, allyl resin, alkyd resin, epoxy resin, silicone resin, phenol resin, phenoxy resin, polyacrylamide, polyamideimide, polyamide, polyallyl ether, polyarylate, polyimide, polyurethane, polyester, polyethylene, polycarbonate, polysulfone, polyphenylene oxide, polybutadiene, polypropylene, methacrylic resin, and the like. Among the above, polyarylate and polycarbonate are suitable. These substances can be used singly or in combination of two or more kinds thereof as a mixture or a copolymer.

The mass ratio of the charge transport material and the binding resin in the charge transport layer is suitably Charge transport material/Binding resin=0.3/1 or more and 10/1 or less. From the viewpoint of suppressing cracks of the charge transport layer, the drying temperature is suitably 60° C. or more and 150° C. or less and more suitably 80° C. or more and 120° C. or less. The drying time is suitably 10 minutes or more and 60 minutes or less.

Solvents for use in the coating liquid for charge transport layer include, for example, ketones, such as acetone and methyl ethyl ketone, esters, such as methyl acetate and ethyl acetate, ethers, such as dimethoxy methane and dimethoxy ethane, aromatic hydrocarbons, such as toluene and xylene, hydrocarbons substituted by halogen atoms, such as chlorobenzene, chloroform, and carbon tetrachloride, and the like.

The film thickness of the charge transport layer is suitably 5 μm or more and 40 μm or less and more suitably 5 μm or more and 30 μm or less. To the charge transport layer, an antioxidant, an ultraviolet absorber, a plasticizer, and the like can also be added as required.

In aspects of the present invention, a protective layer (second charge transport layer) may be provided on the photosensitive layer (on the charge transport layer) for the purpose of an improvement of durability, transferability, and cleaning performance, and the like.

The protective layer can be formed by applying a coating liquid for protective layer obtained by dissolving a binding resin in an organic solvent to form a coating film, and then drying the coating film.

The binding resin for use in the protective layer include, for example, polyvinyl butyral, polyester, polycarbonate, polyamide, polyimide, polyarylate, polyurethane, a styrene-butadiene copolymer, a styrene-acrylic acid copolymer, a styrene-acrylonitrile copolymer, and the like.

From the viewpoint of increasing the wear resistance of the protective layer, it is suitable to use a compound (polymerizable monomer) having a chain polymerizable functional group as the binding resin for use in the protective layer. In order to also impart charge transportability to the protective layer, the protective layer may be formed by curing a monomer material having charge transportability and a polymer type charge transport material employing various crosslinking reactions. In particular, a layer is suitable which is obtained by polymerizing and/or cross-linking a charge transport material having a chain polymerizable functional group to cure the same. The chain polymerizable functional group includes, for example, an acryl group, an alkoxysilyl group, an epoxy group, and the like. The reaction for curing includes, for example, radical polymerization, ionic polymerization, thermal polymerization, photopolymerization, radiation polymerization (electron beam polymerization), a plasma CVD method, an optical CVD method, and the like.

Furthermore, electroconductive particles, an ultraviolet absorber, a wear-resistance improver, and the like can also be added to the protective layer as required. The electroconductive particles are suitably metal oxide particles, such as tin oxide particles, for example. The wear-resistance improver includes, for example, fluorine atom containing resin particles, such as polytetrafluoroethylene particles, alumina particles, silica particles, and the like.

The film thickness of the protective layer is suitably 0.5 μm or more and 20 μm or less and more suitably 1 μm or more and 10 μm or less.

When applying the coating liquid for each layer, coating methods, such as a dip coating method, a spray coating method, a spinner coating method, a roller coating method, a Mayer Bar coating method, and a blade coating method, can be used, for example.

Figure 2:
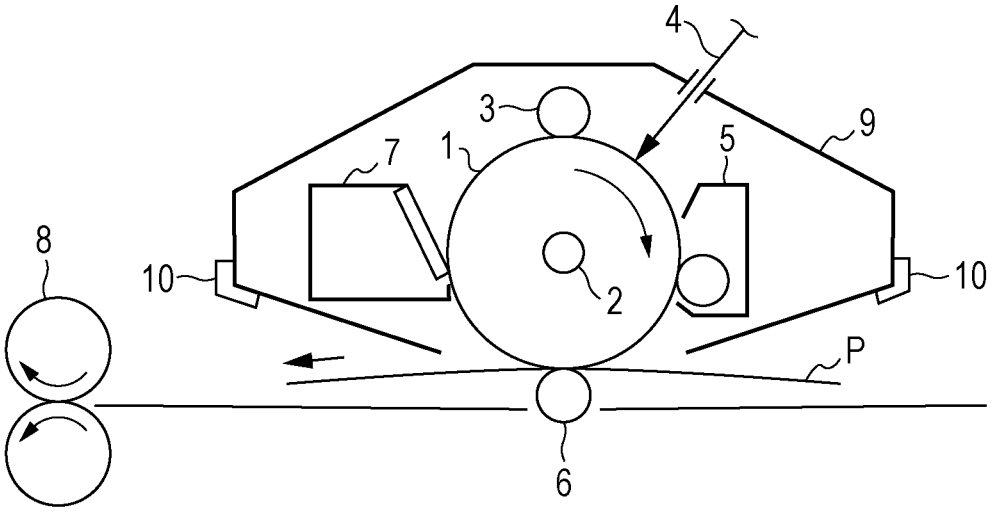
FIG. 2 is a view illustrating an example of the schematic structure of an electrophotographic apparatus having a process cartridge having an electrophotographic photoconductor.

FIG. 2 illustrates the schematic structure of an electrophotographic apparatus having a process cartridge having an electrophotographic photoconductor.

In FIG. 2, a cylindrical electrophotographic photoconductor 1 is rotated and driven with a predetermined circumferential velocity (process speed) in the direction indicated by the arrow around a shaft 2. The surface of the electrophotographic photoconductor 1 is uniformly charged with a predetermined positive or negative potential by a charging device 3 (primary charging device: charging roller and the like) in a rotation process. Subsequently, an exposure light 4 whose intensity is modulated corresponding to a time-sequence electric digital pixel signal of image information to be output from an exposure device (not illustrated), such as slit exposure as a reflected light from an original and laser beam scanning exposure, is received. Thus, an electrostatic latent image corresponding to the target image information is successively formed on the surface of the electrophotographic photoconductor 1.

Subsequently, the electrostatic latent images formed on the surface of the electrophotographic photoconductor 1 are formed into visual images by normal development or reversal development with toner contained in a developing agent in a developing device 5 to be formed into toner images. Subsequently, the toner images formed on the circumferential surface of the electrophotographic photoconductor 1 are successively transferred to a transfer material P by a transfer bias from a transfer device 6 (transfer roller and the like). Herein, the transfer material P is fed between the electrophotographic photoconductor 1 and the transfer device 6 (abutment portion) from a transfer material feeder (not illustrated) synchronizing with the rotation of the electrophotographic photoconductor 1. To the transfer device 6, a bias voltage whose polarity is opposite to the polarity of a charge of the toner is applied from a bias power supply (not illustrated).

The transfer material P to which the toner images are transferred is separated from the circumferential surface of the electrophotographic photoconductor 1 to be conveyed to a fixing means 8, and then subjected to fixing treatment of the toner images, whereby the transfer material P is printed out to the outside of the apparatus as an image formed material (a print, a copy). When the transfer material P is an intermediate transfer body and the like, the transfer material P is subjected to fixing treatment after a plurality of transfer processes, and then printed out.

The circumferential surface of the electrophotographic photoconductor 1 after the toner image transfer is subjected to removal of an untransferred developing agent (untransferred toner) by a cleaning device 7 (cleaning blade and the like) to be cleaned. In recent years, a cleanerless system has also been studied, so that the untransferred toner can also be directly collected by a developing device and the like. Furthermore, the circumferential surface of the electrophotographic photoconductor 1 is subjected to electrostatic elimination treatment by a pre-exposure light (not illustrated) from a pre-exposure device (not illustrated), and then used for repeated image formation. As illustrated in FIG. 2, when the charging device 3 is a contact charging device employing a charging roller and the like, the pre-exposure is not necessarily required.

Among the constituent elements of the electrophotographic photoconductor 1, the charging device 3, the developing device 5, and the cleaning device 7 described above, two or more of the constituent elements may be selected and accommodated in a container, and then integrally combined as a process cartridge. Then, the process cartridge may be attachable/detachable to/from an electrophotographic apparatus main body, such as a copying machine and a laser beam printer. In FIG. 2, the charging device 3, the developing device 5, and the cleaning device 7 can be integrally supported with the electrophotographic photoconductor 1 to form a cartridge, and then can be formed into a process cartridge 9 which is attachable/detachable to/from the apparatus main body employing a guidance device 10, such as a rail of the apparatus main body. The exposure light 4 is a reflected light or a transmitted light from an original when the electrophotographic apparatus is a copying machine or a printer. Alternatively, the exposure light 4 is light emitted by scanning of a laser beam performed according to a signal obtained by converting a read-out original with a sensor to a signal, drive of an LED array, drive of a liquid crystal shutter array, or the like.

EXAMPLES

Hereinafter, aspects of the present invention are described in more detail with reference to specific Examples. However, the present invention is not limited thereto. In Examples, "part(s)" means "part(s) by mass". Example of manufacturing aluminum doped tin oxide covered composite particles Aluminum doped tin oxide covered titanium oxide particles described in Examples can be manufactured as follows. The type of a core material of composite particles, the type and the amount of a doping agent, and the amount of sodium stannate were changed according to Examples.

As the core material particles, 200 g of titanium oxide particles (Average primary particle diameter of 200 nm) were dispersed in water. Then, 208 g of sodium stannate ($Na_2SnO_3$) having a tin content of 41% was added and dissolved to prepare mixed slurry. A diluted aqueous 20% sulfuric acid solution (based on mass) was added while circulating the mixed slurry to neutralize tin. The diluted aqueous sulfuric acid solution was added until the pH of the mixed slurry reached 2.5. After the neutralization, aluminum chloride (9.4% by mol content based on Sn) was added to the mixed slurry, and then the mixed slurry was stirred. Thus, a precursor of the target composite particles was obtained. The precursor was washed with warm water, and then dehydrated and filtered, whereby a solid was obtained. The obtained solid was reduced and calcined at 500° C. under a 2% by volume $H_2/N_2$ atmosphere for 1 hour. Thus, the target electroconductive particles were obtained. The doping amount of the aluminum was 2.0% by mass.

For example, the doping amount of the aluminum (% by mass) based on the tin oxide can be measured using a wavelength dispersion type fluorescent X-ray analyzer (Trade name: Axios) manufactured by Spectris Co., Ltd. As a measurement target, the photosensitive layer of the electrophotographic photoconductor and also, as required, the undercoat layer were separated, the undercoat layer was scraped, and then the scraped undercoat layer can also be used. Powder having the same materials as the materials of the undercoat layer can also be used.

Herein, the doping amount of the aluminum is a value calculated from the mass of the alumina ($Al_2O_3$) based on the mass of the tin oxide.

Example 1

As a support medium, an aluminum cylinder (electroconductive support medium) having a diameter of 30 mm and a length of 357.5 mm was used.

Next, 81 parts of titanium oxide particles each covered with tin oxide doped with aluminum as composite particles (Doping amount of aluminum: 2% by mass, Coverage of tin oxide: 40% by mass, Powder resistivity: $1.9\times10^8$ Ω·cm, Number average particles diameter of 0.48 μm, Powder resistivity of titanium oxide particles as core material particles: $5.4\times10^7$ Ω·cm), 15 parts of butyral resin (Trade name: BM-1, manufactured by Sekisui Chemical Co., Ltd.), and 15 parts of blocked isocyanate (Trade name: Sumidure 3175 manufactured by Sumitomo Beyer Urethane Co., Ltd.) were mixed with a mixed solution of 45 parts of methyl ethyl ketone and 45 parts of 1-butanol, and then dispersed under a 23±3° C. atmosphere for 3 hours with a sand mill device using glass beads having a diameter of 0.8 mm. After the dispersion, 0.01 part of silicone oil (Trade name: SH28PA, manufactured by Dow Corning Toray Silicone) was added. Furthermore, 5.6 parts of crosslinked polymethyl methacrylate (PMMA) particles (Trade name: TECHPOLYMER SSX-102, manufactured by Sekisui Plastics Co., Ltd., Number average particle diameter of 2.7 μm) were added and stirred to prepare a coating liquid for undercoat layer. The content of the crosslinked polymethyl methacrylate particles is 5% by mass based on the solid content of the coating liquid for undercoat layer (Total mass of composite particles, butyral resin, and blocked isocyanate).

The coating liquid for undercoat layer was applied onto the support medium by dip coating to form a coating film, and then the coating film was heated and/or cured at 160° C. for 35 minutes to form an undercoat layer having a film thickness of 22 μm. When the obtained undercoat layer was measured by the measuring method of the volume resistivity described above, the volume resistivity was $2.8\times10^{12}$ Ω·cm.

Next, a hydroxy gallium phthalocyanine crystal (Charge generation material) of a crystal form having peaks at Bragg angle 20±0.2° in CuKα characteristic X-ray diffraction of 7.5° and 28.3° was prepared. 10 parts of the hydroxy gallium phthalocyanine crystal, 0.1 part of a compound (A) represented by the following formula (A), and 5 parts of polyvinyl butyral resin (Trade name: Ethlec BX-1, manufactured by Sekisui Chemical Co., Ltd.) were added to 250 parts of cyclohexanone. The mixture was dispersed under a 23±3° C. atmosphere for 3 hours with a sand mill device using glass beads having a diameter of 0.8 mm. After the dispersion, 100 parts of cyclohexanone and 450 parts of ethyl acetate were added to prepare a coating liquid for charge generation layer. The coating liquid for charge generation layer was applied onto the undercoat layer by dip coating to form a coating film, and then the coating film was dried at 100° C. for 10 minutes to thereby form a charge generation layer having a film thickness of 0.18 μm.

[Chem. 1]

(A)

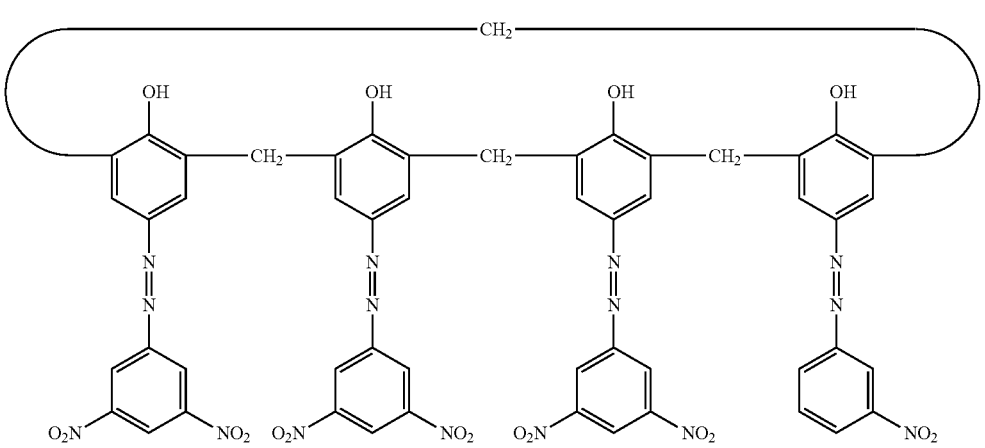

Next, 50 parts of an amine compound (Charge transport material) represented by the following formula (B), 50 parts of an amine compound (Charge transport material) represented by the following formula (C), and 100 parts of polycarbonate resin (Trade name: Iupilon 2400, manufactured by Mitsubishi Gas Chemical Co., Inc.) were dissolved in a mixed solvent of 650 parts of monochlorobenzene and 150 parts of dimethoxy methane to prepare a coating liquid for charge transport layer. The coating liquid for charge transport layer was applied onto the charge generation layer by dip coating to form a coating film, and then the coating film was dried at 110° C. for 30 minutes to form a charge transport layer having a film thickness of 20 μm.

[Chem. 2]

(B)

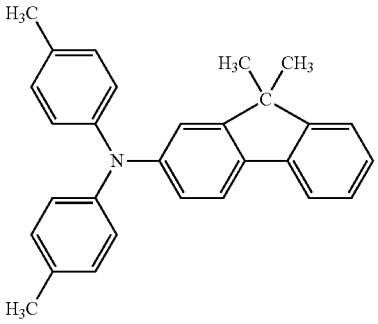

(C)

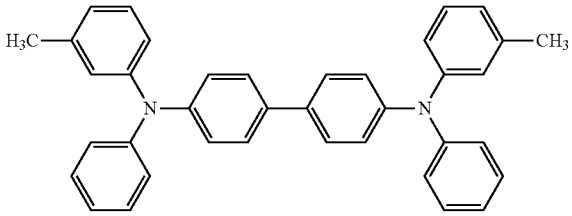

Next, 36 parts of a compound represented by the following formula (D) and 4 parts of polytetrafluoroethylene resin fine powder (Trade name: Lubron L-2, manufactured by Daikin Industries, LTD.) were mixed with 60 parts of n-propyl alcohol, and then dispersed with an ultra high pressure disperser to prepare a coating liquid for protective layer.

[Chem. 3]

(D)

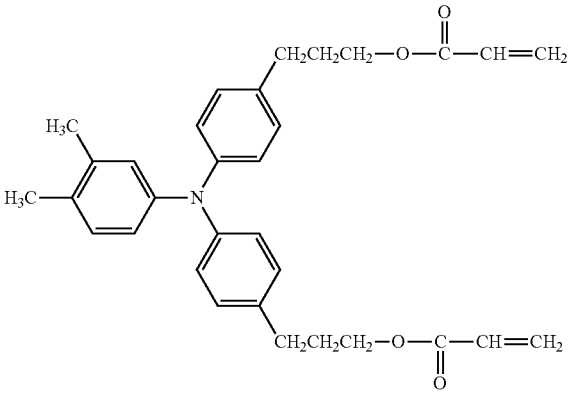

The coating liquid for protective layer was applied onto the charge transport layer by dip coating to form a coating film, and then the coating film was dried at 50° C. for 5 minutes. After the drying, the coating film was irradiated with electron beams for 1.6 seconds under a nitrogen atmosphere under the conditions of an accelerating voltage of 70 kV and an absorbed dose of 10000 Gy. Thereafter, the coating film was heated for 1 minute under a nitrogen atmosphere under the conditions where the temperature of the coating film reached 130° C. The oxygen concentration from the irradiation of electron beams to the heat-treatment for 1 minute was 20 ppm. Next, the coating film was heated for 1 hour in the atmosphere under the conditions where the temperature of the coating film reached 110° C. to form a protective layer having a film thickness of 5 μm. Thus, an electrophotographic photoconductor having the undercoat layer, the charge generation layer, the charge transport layer, and the protective layer on the support medium was manufactured.

Examples 2 to 16

Electrophotographic photoconductors were manufactured in the same manner as in Example 1, except changing the core material particle, the doping amount of the aluminum based on tin oxide and the coverage and the addition amount of tin oxide in Example 1 as shown in Table 1.

Comparative Example 1

An electrophotographic photoconductor was manufactured in the same manner as in Example 1, except changing the doping amount of the aluminum of the composite particles used in Example 1 to 0.8% by mass (Powder resistivity of $8.0\times10^5$ Ω·cm).

Comparative Example 2

An electrophotographic photoconductor was manufactured in the same manner as in Example 1, except changing the composite particles used in Example 1 to titanium oxide particles (Powder resistivity of $1.0\times10^3$ Ω·cm) covered with oxygen-deficient tin oxide.

Comparative Example 3

An electrophotographic photoconductor was manufactured in the same manner as in Example 1, except changing the composite particles used in Example 1 to titanium oxide particles (Powder resistivity of $1.5\times10^2$ Ω·cm) covered with tin oxide doped with phosphorous.

Comparative Example 4

An electrophotographic photoconductor was manufactured in the same manner as in Example 1, except changing the composite particles used in Example 1 to titanium oxide particles (Powder resistivity of $3.2\times10^2$ Ω·cm) covered with tin oxide doped with tungsten.

CANON KABUSHIKI KAISHA was used. The process speed was set to 320 mm/sec as the modified point.

The evaluation device was placed in a high temperature and high humidity environment of a temperature of 30° C. and a humidity of 85% RH. As the charging conditions, an alternating current component to be applied to a charging roller was set to a voltage between peaks of 1500 V and a frequency of 1500 Hz, and a direct-current component (initial dark area potential (Vda)) was set to −750 V. As the exposure conditions, the exposure conditions were adjusted in such a manner that the initial light area potential (Vla) in 780 nm laser exposure was −200 V.

The surface potential of the electrophotographic photoconductor was measured by removing a cartridge for development from the evaluation device, and then inserting a potential meter thereinto. The potential meter is configured by disposing a potential measurement probe at a developing position of the cartridge for development. The position of the potential measurement probe to the electrophotographic photoconductor was set to a position with a gap from the surface of the electrophotographic photoconductor of 3 mm at the center in the generatrix direction of the electrophotographic photoconductor.

Next, the evaluation is described. Each electrophotographic photoconductor was evaluated under the charging conditions and exposure conditions set as described above. The cartridge for development to which the electrophotographic photoconductor was attached was attached to the evaluation device, and then the electrophotographic photoconductor was repeatedly used in continuous 100000 rotations in a high temperature and high humidity environment of a temperature of 30° C. and a humidity of 85% RH. After the repeated use of 100000 rotations, the electrophotographic photoconductor was allowed to stand for 5 minutes, the cartridge for development was changed to the potential meter, and then the dark area potential (VDb) and the light area potential (VLb) after the repeated use in a high temperature and high humidity environment were measured. A difference between the light area potential after repeated use and the initial light area potential was determined as the light area

TABLE 1

| | | Metal oxide particles | | | | | |
|---|---|---|---|---|---|---|---|
| | No. | Cover layer | Doping amount based on tin oxide [% by mass] | Coverage of tin oxide [% by mass] | Powder resistivity [Ω · cm] | Addition amount [Part] | Mass ratio (Metal oxide particles):(Binding resin) |
| Examples | 1 | Aluminum doped tin oxide covered titanium oxide | 2 | 40 | $1.9\times10^8$ | 81 | 2.7:1 |
| | 2 | Aluminum doped tin oxide covered titanium oxide | 1 | 50 | $2.2\times10^8$ | 81 | 2.7:1 |
| | 3 | Aluminum doped tin oxide covered titanium oxide | 1.5 | 60 | $3.8\times10^8$ | 81 | 2.7:1 |
| | 4 | Aluminum doped tin oxide covered titanium oxide | 3 | 40 | $3.2\times10^8$ | 81 | 2.7:1 |
| | 5 | Aluminum doped tin oxide covered titanium oxide | 4 | 30 | $2.6\times10^8$ | 81 | 2.7:1 |
| | 6 | Aluminum doped tin oxide covered titanium oxide | 2 | 50 | $3.6\times10^8$ | 120 | 4:1 |
| | 7 | Aluminum doped tin oxide covered titanium oxide | 2.5 | 30 | $1.3\times10^8$ | 105 | 3.5:1 |
| | 8 | Aluminum doped tin oxide covered titanium oxide | 1.5 | 30 | $7.1\times10^7$ | 81 | 2.7:1 |
| | 9 | Aluminum doped tin oxide covered titanium oxide | 4 | 20 | $3.5\times10^7$ | 60 | 2:1 |
| | 10 | Aluminum doped tin oxide covered titanium oxide | 1 | 20 | $1.2\times10^6$ | 60 | 2:1 |
| | 11 | Aluminum doped tin oxide covered titanium oxide | 3.5 | 60 | $8.1\times10^8$ | 120 | 4:1 |
| | 12 | Aluminum doped tin oxide covered titanium oxide | 3 | 30 | $1.7\times10^8$ | 90 | 3:1 |
| | 13 | Aluminum doped tin oxide covered titanium oxide | 3.5 | 30 | $2.1\times10^8$ | 81 | 2.7:1 |
| | 14 | Aluminum doped tin oxide covered barium sulfate | 2 | 40 | $1.7\times10^8$ | 90 | 3:1 |
| | 15 | Aluminum doped tin oxide covered barium sulfate | 1 | 50 | $2.5\times10^8$ | 105 | 3.5:1 |
| | 16 | Aluminum doped tin oxide covered barium sulfate | 4 | 60 | $9.3\times10^8$ | 81 | 2.7:1 |
| Comparative Examples | 1 | Aluminum doped tin oxide covered titanium oxide | 0.8 | 40 | $8.0\times10^5$ | 81 | 2.7:1 |
| | 2 | Oxygen-deficient tin oxide covered titanium oxide | — | 40 | $1.0\times10^3$ | 81 | 2.7:1 |
| | 3 | Phosphorous doped tin oxide covered titanium oxide | 2 | 40 | $1.5\times10^2$ | 81 | 2.7:1 |
| | 4 | Tungsten doped tin oxide covered titanium oxide | 2 | 40 | $3.2\times10^2$ | 81 | 2.7:1 |

The electrophotographic photoconductors manufactured in Examples 1 to 16 and Comparative Examples 1 to 4 are evaluated as follows.

(Evaluation of Potential Changes in Repeated Use)

As an evaluation device, a modified machine of a copying machine image RUNNER iR-ADV C5051 manufactured by potential change amount (ΔVL=|VLb|−|VLb| and a difference between the dark area potential after repeated use and the initial dark area potential was determined as the dark area potential change amount (ΔVD=|VDb|−|VDa|. The evaluation results are shown in Table 2.

TABLE 2

| | No. | Volume resistivity of undercoat layer [Ω · cm] | Evaluation results ΔVD [V] | ΔVL [V] |
|---|---|---|---|---|
| Examples | 1 | $2.8 \times 10^{12}$ | −4 | +4 |
| | 2 | $2.5 \times 10^{12}$ | −5 | +4 |
| | 3 | $5.0 \times 10^{12}$ | −4 | +4 |
| | 4 | $4.1 \times 10^{12}$ | −3 | +4 |
| | 5 | $3.3 \times 10^{12}$ | −4 | +3 |
| | 6 | $2.0 \times 10^{12}$ | −4 | +5 |
| | 7 | $6.5 \times 10^{11}$ | −6 | +5 |
| | 8 | $3.2 \times 10^{12}$ | −7 | +5 |
| | 9 | $7.4 \times 10^{12}$ | −7 | +4 |
| | 10 | $5.3 \times 10^{9}$ | −7 | +5 |
| | 11 | $3.4 \times 10^{12}$ | −5 | +4 |
| | 12 | $2.6 \times 10^{12}$ | −4 | +5 |
| | 13 | $2.2 \times 10^{12}$ | −4 | +5 |
| | 14 | $3.1 \times 10^{12}$ | −4 | +4 |
| | 15 | $1.9 \times 10^{12}$ | −5 | +5 |
| | 16 | $8.9 \times 10^{12}$ | −4 | +5 |
| Comparative Examples | 1 | $3.2 \times 10^{10}$ | −10 | +20 |
| | 2 | $4.5 \times 10^{9}$ | −30 | +50 |
| | 3 | $4.3 \times 10^{10}$ | −10 | +5 |
| | 4 | $7.2 \times 10^{10}$ | −10 | +5 |

These results show that, by blending the composite particles each containing the core material particle covered with tin oxide doped with 1 to 4% by mass of aluminum in the undercoat layer, the dark area potential change amount and the light area potential change amount in repeated use for a long period of time are suppressed.

Reference Example 1

As a support medium, the same aluminum cylinder as that of Example 1 was used.

Next, an undercoat layer was formed in the same manner as in Example 1, except changing the composite particles used in Example 1 to titanium oxide particles (Powder resistivity of $1.5\times10^2$ Ω·cm) each covered with tin oxide doped with phosphorus.

Next, 4.5 parts of N-methoxy methylated nylon (Trade name: Toresin EF-30T, manufactured by TEIKOKU CHEM IND CORP LTD) and 1.5 parts of a copolymerized nylon resin (Amilan CM8000, manufactured by Toray Industries) were dissolved in a mixed solvent of 65 parts of methanol/30 parts of n-butanol. The obtained coating liquid for intermediate layer was applied onto the undercoat layer by dip coating to form a coating film, and then the coating film was dried at 100° C. for 10 minutes to form an intermediate layer having a film thickness of 0.8 μm.

Next, a charge generation layer, a charge transport layer, and a protective layer were formed in the same manner as in Example 1. Thus, an electrophotographic photoconductor having the undercoat layer, the intermediate layer, the charge generation layer, the charge transport layer, and the protective layer on the support medium was manufactured.

When the manufactured electrophotographic photoconductor was evaluated for the potential changes in repeated use in the same manner as in Example 1, the light area potential change amount (ΔVL) was −5 V and the dark area potential change amount (ΔVD) was +5 V, which were comparable to those of Examples described above.

Reference Example 2

As a support medium, the same aluminum cylinder as that of Example 1 was used.

Next, an undercoat layer was formed in the same manner as in Example 1, except changing the composite particles used in Example 1 to titanium oxide particles (Powder resistivity of $3.2\times10^2$ Ω·cm) each covered with tin oxide doped with tungsten.

Next, an intermediate layer, a charge generation layer, a charge transport layer, and a protective layer were formed, and then an electrophotographic photoconductor was manufactured in the same manner as in Reference Example 1.

When the manufactured electrophotographic photoconductor was evaluated for the potential changes in repeated use in the same manner as in Example 1, the light area potential change amount (ΔVL) was −5 V the dark area potential change amount (ΔVD) was +5 V, which were comparable to those of Examples described above.

EFFECTS OF THE INVENTION

Aspects of the present invention can provide an electrophotographic photoconductor in which the light area potential changes and the dark area potential changes in repeated use for a long period of time are suppressed. Aspects of the present invention can also provide a process cartridge and an electrophotographic apparatus having the electrophotographic photoconductor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-033341 filed Feb. 24, 2014, which is hereby incorporated by reference herein in its entirety.

What is claimed is:

1. An electrophotographic photoconductor comprising:
a support medium;
an undercoat layer formed immediately on the support medium; and
a photosensitive layer formed immediately on the undercoat layer
wherein the undercoat layer contains
a binding resin, and
composite particles,
the composite particles each containing
a core material particle and
tin oxide covering the core material particle and doped with aluminum, and
a doping amount of the aluminum based on the tin oxide is 1% by mass or more and 4% by mass or less.

2. The electrophotographic photoconductor according to claim 1, wherein the core material particle is a titanium oxide particle or a barium sulfate particle.

3. The electrophotographic photoconductor according to claim 1, wherein a coverage of the tin oxide based on the composite particles is 20% by mass or more and 60% by mass or less.

4. The electrophotographic photoconductor according to claim 1, wherein the binding resin is a cured resin.

5. The electrophotographic photoconductor according to claim 1, wherein a powder resistivity of the composite particles is $1\times10^{6}$ Ω·cm or more.

6. The electrophotographic photoconductor according to claim 5, wherein a powder resistivity of the composite particles is $1.5\times10^{8}$ Ω·cm or more and $1\times10^{9}$ Ω·cm or less.

7. The electrophotographic photoconductor according to claim 1, wherein a volume resistivity of the undercoat layer is $1\times10^{9}$ Ω·cm or more and $1\times10^{13}$ Ω·cm or less.

8. The electrophotographic photoconductor according to claim 1, further comprising a protective layer on the photosensitive layer, wherein the protective layer contains a polymerized substance of a compound having a chain polymerizable functional group.

9. A process cartridge comprising:

the electrophotographic photoconductor according to claim 1; and at least one device selected from the group consisting of a charging device, a developing device, a transfer device, and a cleaning device, the electrophotographic photoconductor and the at least one device being integrally supported, wherein the process cartridge is attachable/detachable to/from to an electrophotographic apparatus main body.

10. An electrophotographic apparatus comprising:

the electrophotographic photoconductor according to claim 1;

a charging device;

an exposure device;

a developing device; and a transfer device.

* * * * *